US009777743B2

(12) United States Patent
Yang et al.

(10) Patent No.: US 9,777,743 B2
(45) **Date of Patent: *Oct. 3, 2017**

(54) CENTRIFUGAL FAN IMPELLER STRUCTURE

(71) Applicant: ASIA VITAL COMPONENTS CO., LTD., Sinjhuang District, New Taipei (TW)

(72) Inventors: Chih-Wei Yang, New Taipei (TW); Sheng-Pei Lee, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 895 days.

This patent is subject to a terminal disclaimer.

(21) Appl. No.: 13/669,448

(22) Filed: Nov. 6, 2012

(65) Prior Publication Data

US 2014/0127024 A1 May 8, 2014

(51) Int. Cl.

| | |
|---|---|
| ***F04D 29/28*** | (2006.01) |
| ***F04D 17/16*** | (2006.01) |
| ***F04D 29/30*** | (2006.01) |
| ***F04D 29/66*** | (2006.01) |

(52) U.S. Cl.

CPC ..... *F04D 29/281* (2013.01); *F04D 17/162* (2013.01); *F04D 29/30* (2013.01); *F04D 29/666* (2013.01); *F05D 2240/304* (2013.01)

(58) Field of Classification Search

CPC .... F04D 29/2216; F04D 29/66; F04D 29/661; F04D 29/666; F04D 17/162; F04D 29/281; F04D 29/30; G06F 1/203; H05K 7/20–7/20209; F05D 2240/304

See application file for complete search history.

(56) References Cited

U.S. PATENT DOCUMENTS

| | | | | |
|---|---|---|---|---|
| 2,227,373 | A * | 12/1940 | Behrens | 415/144 |
| 4,253,800 | A * | 3/1981 | Segawa | F01D 5/10 415/119 |
| 4,662,830 | A * | 5/1987 | Pottebaum | 417/424.1 |
| 4,923,365 | A * | 5/1990 | Rollwage | 415/119 |
| 5,026,251 | A * | 6/1991 | Kinoshita et al. | 415/119 |
| 5,681,145 | A * | 10/1997 | Neely et al. | 416/203 |
| 6,340,291 | B1 * | 1/2002 | Reckert | 416/185 |
| 6,488,472 | B1 * | 12/2002 | Miyazawa | 416/144 |
| 6,568,907 | B2 * | 5/2003 | Horng et al. | 416/185 |
| 6,579,064 | B2 * | 6/2003 | Hsieh | 416/182 |
| 7,300,244 | B2 * | 11/2007 | Baugh et al. | 415/119 |
| 7,597,541 | B2 * | 10/2009 | White | 416/183 |
| 8,221,069 | B2 * | 7/2012 | Ogino | F04D 29/282 415/206 |

(Continued)

*Primary Examiner* — Dwayne J White
*Assistant Examiner* — Adam W Brown
(74) *Attorney, Agent, or Firm* — C. G. Mersereau; Nikolai & Mersereau, P.A.

(57) ABSTRACT

A centrifugal fan impeller structure includes a hub and a blade body set. The hub has an extension section. The blade body set has multiple blade bodies. The blade bodies outward extend from the extension section of the hub. Each two adjacent blade bodies define therebetween a flow way, an air outlet and an air inlet. The air outlet and the air inlet are respectively positioned at two ends of the flow way in communication with the flow way. The air outlets are arranged at unequal intervals so as to greatly reduce noise in operation.

3 Claims, 4 Drawing Sheets

(56) References Cited

U.S. PATENT DOCUMENTS

| | | | | |
|---|---|---|---|---|
| 2002/0146318 | A1* | 10/2002 | Horng | F04D 25/0613<br>415/204 |
| 2007/0140832 | A1* | 6/2007 | Chiang et al. | 415/72 |
| 2008/0247868 | A1* | 10/2008 | Lan et al. | 415/182.1 |

* cited by examiner

CENTRIFUGAL FAN IMPELLER STRUCTURE

BACKGROUND OF THE INVENTION

1. Field of the Invention

The present invention relates generally to a centrifugal fan impeller structure, and more particularly to a centrifugal fan impeller structure, which can reduce noise in operation of the centrifugal fan.

2. Description of the Related Art

Along with the rapid development of electronic industries, the performance of the electronic components has been more and more enhanced. The electronic components have operated at higher and higher speed. In the meantime, the heat generated by the electronic components has become higher and higher. In case the heat is not dissipated in time, the operation performance of the electronic components will be deteriorated. In some more serious cases, the electronic components may even burn out. In order to dissipate the heat, a miniaturized centrifugal fan is installed in a limited space of the system for carrying away the heat. The centrifugal fan includes a frame body, a fan hub and multiple blade bodies annularly disposed around outer circumference of the fan hub. Each of upper and lower sides of the frame body is formed with an air inlet. A lateral side of the frame body is formed with an air outlet. In operation, the blade bodies rotate to drive the ambient air to flow. The axial airflow going into the frame body from the air inlet is turned to radial airflow, which is exhausted from the air outlet.

When the centrifugal fan operates, the non-uniform wake flowing out from the fan impeller will interact with the tongue to make noise. In the case that the gap between the fan impeller and the tongue is relatively narrow, the noise will be affected by the tongue oscillation caused by the impact of the non-uniform wake onto the tongue and the pressure difference around the tongue. In the case that the gap is 20% the radius of the fan impeller, only the non-uniform wake will affect the major noise source and the non-uniform wake only has little affection on the major noise source. In addition, the wake strength can be lowered by means of adding short vanes between the blades. This can minimize the affection of the non-uniform wake on the pressure turbulence and the noise. According to the above, the conventional centrifugal fan has the following shortcomings:

1. The structural design is limited.
2. The conventional centrifugal fan cannot be flexibly designed according to the characteristics.
3. The noise is loud.

SUMMARY OF THE INVENTION

It is therefore a primary object of the present invention to provide a centrifugal fan impeller structure, which can reduce noise.

To achieve the above and other objects, the centrifugal fan impeller structure of the present invention includes a hub and a blade body set.

The hub has an extension section. The blade body set has multiple blade bodies. The blade bodies outward extend from the extension section of the hub. Each two adjacent blade bodies define therebetween a flow way, an air outlet and an air inlet. The air outlet and the air inlet are respectively positioned at two ends of the flow way in communication with the flow way. The air outlets between the blade bodies are selectively arranged at unequal intervals. This can lower the single tone of the blade passing frequency (BPF) and increase the blade passing frequency (BPF) and lower sound pressure weighting so as to greatly reduce noise. In addition, the blade structure can be more flexibly designed according to the boundary condition.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
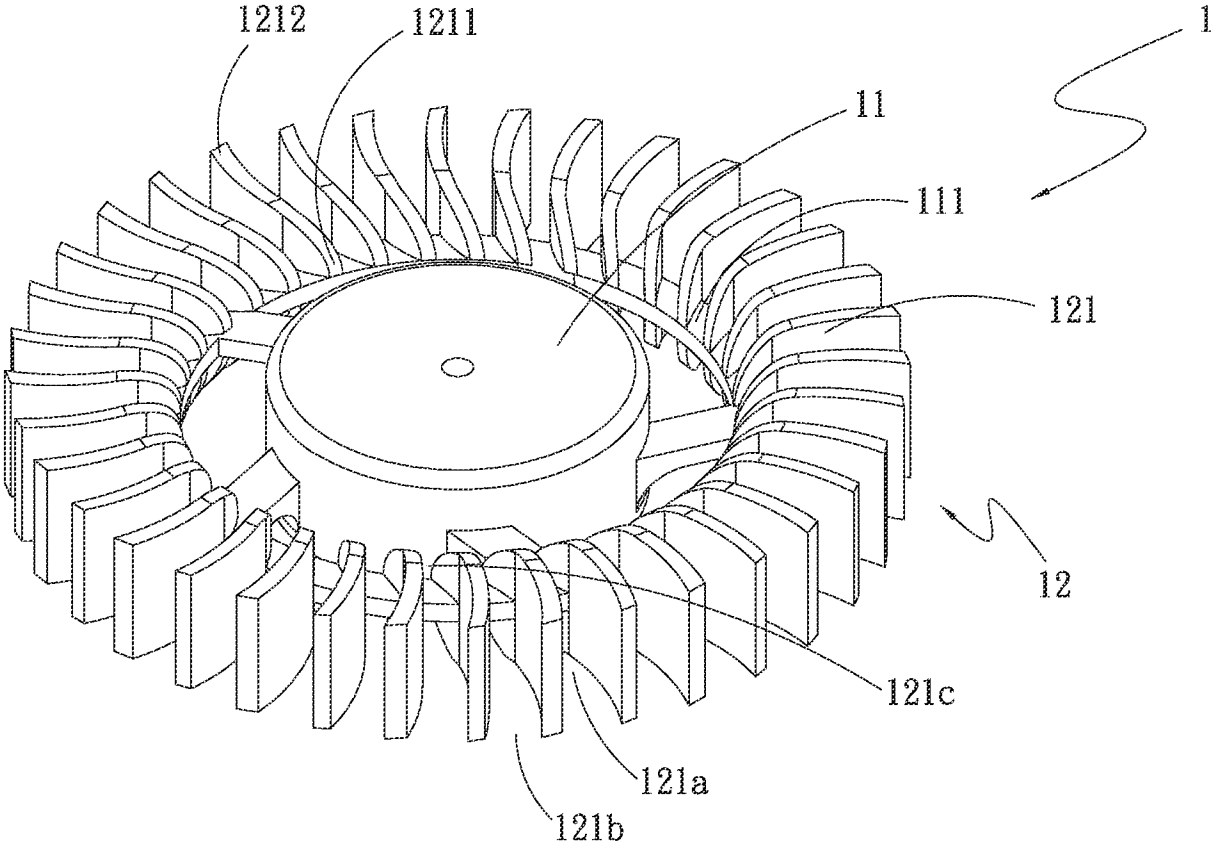
FIG. 1 is a perspective view of a first embodiment of the centrifugal fan impeller structure of the present invention.
Figure 2:
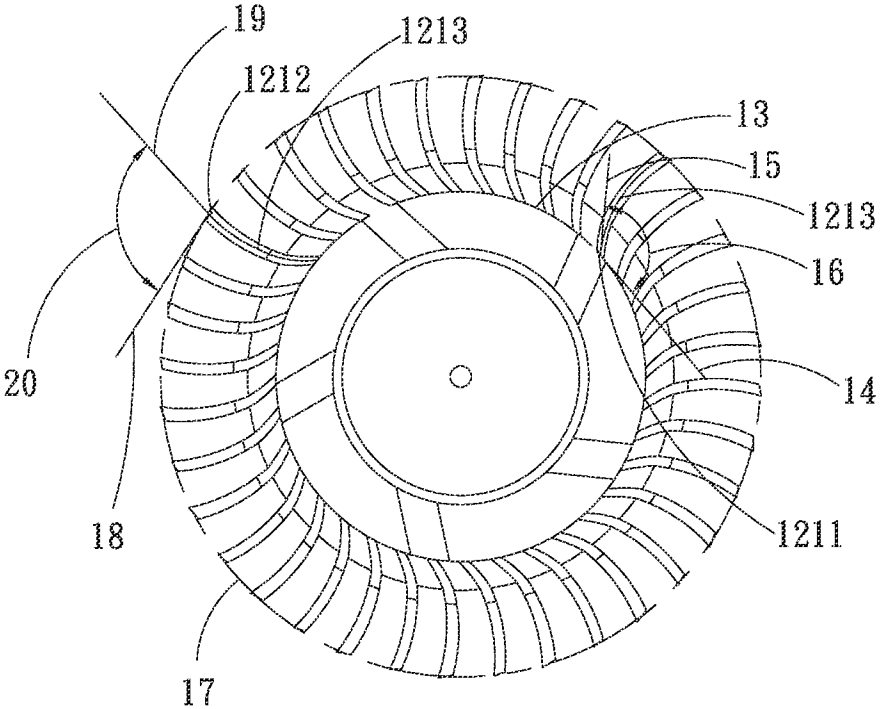
FIG. 2 is a top view of the first embodiment of the centrifugal fan impeller structure of the present invention.

Please refer to FIGS. 1 and 2. FIG. 1 is a perspective view of a first embodiment of the centrifugal fan impeller structure of the present invention. FIG. 2 is a top view of the first embodiment of the centrifugal fan impeller structure of the present invention.

According to the first embodiment, the centrifugal fan impeller structure 1 of the present invention includes a hub 11 and a blade body set 12.

The hub 11 has an extension section 111.

The blade body set 12 has multiple blade bodies 121 outward extending from the extension section 111. Each two adjacent blade bodies 121 define therebetween a flow way 121*a*, an air outlet 121*b* and an air inlet 121*c*. The air outlet 121*b* and the air inlet 121*c* are respectively positioned at two ends of the flow way 121*a* in communication with the flow way 121*a*. The air outlets 112*b* are arranged at unequal intervals.

Each blade body 121 has a first end 1211 and a second end 1212. The air inlet 121*c* is defined between the first ends 1211 of each two adjacent blade bodies 121. The air outlet 121*b* is defined between the second ends 1212 of each two adjacent blade bodies 121.

The first ends 1211 together define a first pitch circle 13. A tangent of the first pitch circle 13 at the first end 1211 is defined as a first tangent 14. The blade body 121 has a blade body central line 1213. A tangent of the blade body central line 1213 at the first end 1211 is defined as a second tangent 15. The second tangent 15 intersects the first tangent 14 to contain an air incoming angle 16.

The second ends 1212 together define a second pitch circle 17. A tangent of the second pitch circle 17 at the second end 1212 is defined as a third tangent 18. A tangent of the blade body central line 1213 at the second end 1212 is defined as a fourth tangent 19. The fourth tangent 19 intersects the third tangent 18 to contain an air outgoing angle 20. In this embodiment, the second ends 1212 have unequal widths.

That is, the blade bodies 121 with two different widths are alternately annularly disposed on the extension section 111 of the hub 11, whereby the air outlets 121*b* are arranged at unequal intervals.

Figure 3:
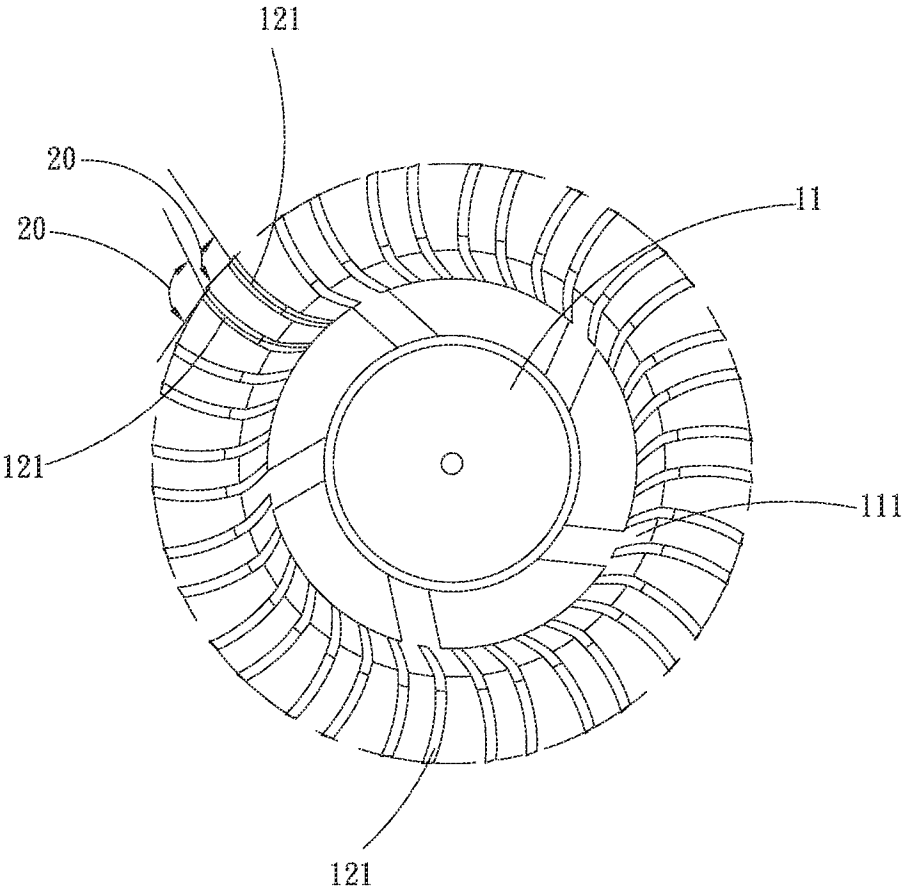
FIG. 3 is a top view of a second embodiment of the centrifugal fan impeller structure of the present invention.

Please now refer to FIG. 3, which is a top view of a second embodiment of the centrifugal fan impeller structure of the present invention. The second embodiment is partially identical to the first embodiment in structure and thus will not be repeatedly described hereinafter. The second embodiment is different from the first embodiment in that the air outgoing angles 20 are unequal. That is, the air outgoing angles 20 of at least two blade bodies 121 are unequal to each other. The blade bodies 121 with two different air outgoing angles 20 can be alternately annularly disposed on the extension section 111 of the hub 11.

Figure 4:
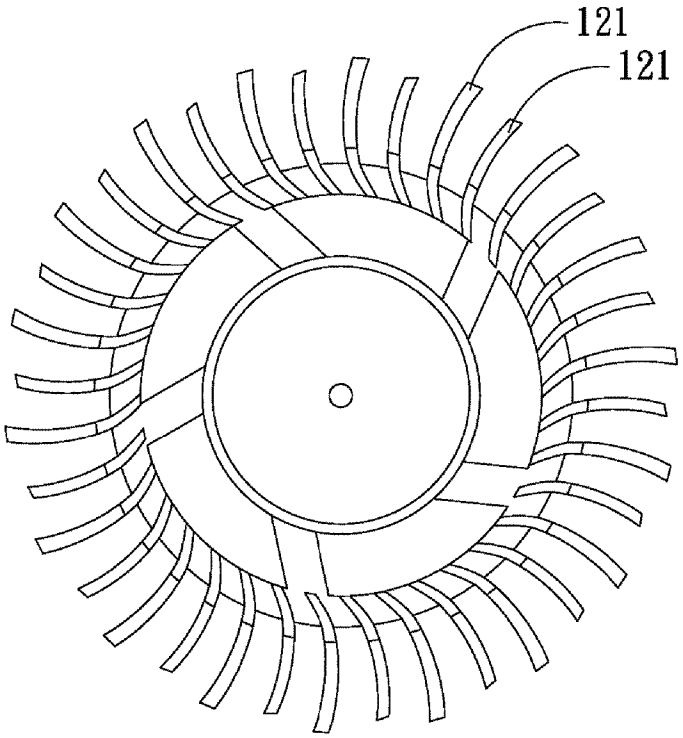
FIG. 4 is a top view of a third embodiment of the centrifugal fan impeller structure of the present invention.

Please now refer to FIG. 4, which is a top view of a third embodiment of the centrifugal fan impeller structure of the present invention. The third embodiment is partially identical to the first embodiment in structure and thus will not be repeatedly described hereinafter. The third embodiment is different from the first embodiment in that at least one of the blade bodies 121 has a length unequal to that of the other blade bodies 121.

The present invention has been described with the above embodiments thereof and it is understood that many changes and modifications in the above embodiments can be carried out without departing from the scope and the spirit of the invention that is intended to be limited only by the appended claims.

What is claimed is:

1. A centrifugal fan impeller structure comprising:

a hub having an extension section, the extension section having multiple extending arms and an annular body, two ends of each of the extending arms being respectively connected with the huh and the annular body, each two adjacent extending anus defining therebetween a through hole; and a blade body set having multiple blade bodies, the blade bodies outward extending from the annular body of the extension section of the hub, each two adjacent blade bodies defining therebetween a flow way, an air outlet and an air inlet, the air outlet and the air inlet being respectively positioned at two ends of the flow way in communication with the flow way, the air outlets being arranged at unequal intervals, the air inlets being arranged at equal intervals;

wherein each blade body has a first end and a second end, the air inlet being defined between the first ends of each two adjacent blade bodies, the air outlet being defined between the second ends of each two adjacent blade bodies;

wherein the first ends together define a first pitch circle, a tangent of the first pitch circle at the first end being defined as a first tangent, the blade body having a blade central line, a tangent of the blade body central line at the first end being defined as a second tangent, the second tangent intersecting the first tangent to contain an air incoming angle;

wherein the second ends together define a second pitch circle, a tangent of the second pitch circle at the second end being defined as a third tangent, the blade body having a blade body central line, a tangent of the blade body central line at the second end being defined as a fourth tangent, the fourth tangent intersecting the third tangent to contain an air outgoing angle, the air outgoing angles of the blades being unequal; and wherein the air outgoing angles of the adjacent blade bodies are different, and the blade bodies with different air outgoing angles are positioned on the extending section of the hub.

2. A centrifugal fan impeller structure comprising:

a hub having an extension section, the extension section having multiple extending arms and an annular body, two ends of each of the extending arms being respectively connected with the hub and the annular body, each two adjacent extending arms defining therebetween a through hole; and a blade body set having multiple blade bodies, the blade bodies outward extending from the annular body of the extension section of the hub, each two adjacent blade bodies defining therebetween a flow way, an air outlet and an air inlet, the air outlet and the air inlet being respectively positioned at two ends of the flow way in communication with the flow way, the air outlets being arranged at equal intervals, the air inlets being arranged at equal intervals;

wherein each blade body has a first end and a second end, the air inlet being defined between the first ends of each two adjacent blade bodies, the air outlet being defined between the second ends of each two adjacent blade bodies;

wherein the first ends together define a first pitch circle, a tangent of the first pitch circle at the first end being defined as a first tangent, the blade body having a blade central line, a tangent of the blade body central line at the first end being defined as a second tangent, the second tangent intersecting the first tangent to contain an air incoming angle;

wherein the second ends together define a second pitch circle, a tangent of the second pitch circle at the second end being defined as a third tangent, the blade body having a blade body central line, a tangent of the blade body central line at the second end being defined as a fourth tangent, the fourth tangent intersecting the third tangent to contain an air outgoing angle, the air outgoing angles of the blades being equal; and wherein the second ends have unequal widths.

3. A centrifugal fan impeller structure comprising:

a hub having an extension section, the extension section having multiple extending arms and an annular body, two ends of each of the extending arms being respectively connected with the hub and the annular body, each two adjacent extending arms defining therebetween a through hole; and a blade body set having multiple bodies, the blade bodies outward extending from the annular body of the extension section of the hub, each two adjacent blade bodies defining therebetween a flow way, an air out and an air inlet, the air outlet and the air inlet being respectively positioned at two ends of the flow way in communication with the flow way, the air outlets being arranged at unequal intervals, the air inlets being arranged at equal intervals;

wherein each blade body has a first end and a second end, the air inlet being defined between the first ends of each two adjacent blade bodies, the air outlet being defined between the second end of each two adjacent blade bodies;

wherein the first ends together define a first pitch circle, a tangent of the first pitch circle at the first end being defined as a first tangent, the blade body having a blade central line, a tangent of the blade body central line at the first end being defined as a second tangent, the second tangent intersecting the first tangent to contain an air incoming angle;

wherein the second ends together define a second pitch circle, a tangent of the second pitch circle at the second end being defined a second pitch circle, the blade body having a blade body central line, a tangent of the blade body central line at the second end being defined as a fourth tangent, the fourth tangent intersecting the third tangent to contain an air outgoing angle; and wherein at least one of the blade bodies has a length unequal to that of the other blade bodies.

* * * * *